US006269614B1

(12) United States Patent
Spina et al.

(10) Patent No.: US 6,269,614 B1
(45) **Date of Patent: *Aug. 7, 2001**

(54) APPARATUS AND METHOD FOR BURSTING PERFORATIONS ON AN ARTICLE

(75) Inventors: John A. Spina, Hamlin; John DePoint, Jr., Palmyra; Marion T. Juskiewicz, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/430,581

(22) Filed: Oct. 29, 1999

(51) Int. Cl.[7] ..... B65B 43/38

(52) U.S. Cl. ..... 53/492; 53/381.2; 53/381.4; 53/382.4

(58) Field of Search ..... 53/492, 50, 381.2, 53/382.1, 381.4, 381.1; 225/94, 96, 96.5

(56) References Cited

U.S. PATENT DOCUMENTS 3,889,442 * 6/1975 Grahn et al. ..... 53/381.2
3,903,677 * 9/1975 Bowman et al. ..... 53/381.1
4,817,260 * 4/1989 Martin ..... 53/492
5,407,116 * 4/1995 Nishishita et al. ..... 225/96.5
5,452,506 * 9/1995 Biedermann et al. ..... 53/381.4
5,568,750 * 10/1996 Galen ..... 53/382.1
6,050,063 * 4/2000 Ford et al. ..... 53/381.1

* cited by examiner

*Primary Examiner*—Peter Vo
*Assistant Examiner*—Sam Tawfik
(74) *Attorney, Agent, or Firm*—Clyde E. Bailey, Sr.

(57) ABSTRACT

An apparatus for bursting perforations on an article has a retractable burst member and an opposed second retractable burst member that imposes an impact force on the perforations on the perforated lid. Retractable burst members are arranged for vertical movement towards and away from one another in a common plane. The article is positioned in a plane substantially perpendicular to the movement of the burst members so that the burst members can engageably contact the article at the perforations. A separator is used to capture the perforated lid at the burst perforations and then retract for separating the perforated lid from the main portion of the article.

8 Claims, 6 Drawing Sheets

APPARATUS AND METHOD FOR BURSTING PERFORATIONS ON AN ARTICLE

CROSS-REFERENCE TO RELATED APPLICATIONS

The present application is related to U.S. application Ser. No. 09/430,455, filed Oct. 29, 1999, by John A. Spina, et al., and entitled, "Apparatus For Opening A Perforated Article, Such As A Corrugated Box;" and U.S. application Ser. No. 09/430,573, filed Oct. 29, 1999, by John A. Spina, et al., and entitled, "Method Of Opening A Perforated Article."

FIELD OF THE INVENTION

The invention relates generally to the field of perforated articles, and in particular to an apparatus for bursting perforations in the article, such as a box, for accessing the interior without damaging the article.

BACKGROUND OF THE INVENTION

Packages having perforations that must be broken to access the interior compartment are widely used in the product supply chain. The shipment of some photosensitive products, such as X-ray film, is widely accomplished in corrugated boxes having a perforated lid for accessing the X-ray film product therein. The perforations along the perforated lid and the main body of the corrugated box must be at least partially burst so that access to the product can be easily achieved. Presently, such perforations along the perforated lid are burst by any one of several ways including manually by hand or by equipment that applies opposing forces to an end of the corrugated box body and the perforated lid. In some instances, products such as X-ray film may be shipped in a corrugated box having the perforated lid pre-separated from the main body of the box. However, experience indicates that each of the aforementioned practices of shipping products in a package with a perforated lid has well known shortcomings and, therefore is undesirable for select applications, such as where an adhesive product label is used to rejoin the separated perforated lid with the main box body.

Removing the perforated box lid manually by hand is known to introduce unacceptable ergonomic problems for the operator. Suppliers who ship the corrugated boxes with the perforated lid removed introduce an expensive alternative because the product, i.e., the X-ray film, would have to be introduced into the box and then a product label applied. Moreover, in this latter instance, the perforated lid may not properly align with the main body of the corrugated box when it is desirable to reseal the box.

Known methods and apparatus for opening a lid of a box include that disclosed in U.S. Pat. No. 5,361,562, by Nagaoka et al., Nov. 8, 1994, and titled, "Method And Apparatus For Opening Lid Of Box" in which a gas is injected into the upper lid of the box that causes the lid to separate from the body of the box. Nagaoka et al., however, does not teach or suggest removing a perforated lid from a corrugated box.

Therefore, there persists a need for an apparatus and method for bursting perforations on an article, such as a corrugated box, that solves the aforementioned problems in the art.

SUMMARY OF THE INVENTION

It is, therefore, an object of the invention to provide an apparatus that can burst perforations in a corrugated box by applying a controlled impact force to a portion of the box near the perforations.

It is another object of the invention to provide an apparatus that uses dual burst members for bursting perforations arranged on the box.

Yet another object of the invention is to provide an apparatus can separate the perforated lid once the perforations are burst.

It is a feature of the invention that opposing burst members sequentially exert a predetermined impact force on a portion of the corrugated box near the perforations. A retractable separator member then grasps the perforated lid with perforations at least partially burst and, upon retracting, separate the perforated lid from the main body of the corrugated box.

To achieve one or more of the objects, features and advantages of the invention, there is provided, in one aspect of the invention, apparatus for bursting perforations on an article having a main body portion and a perforated lid, said perforated lid being separable from said main body portion at perforations along the periphery of said main body portion, said apparatus comprising:

a frame having a substantially flat, movable surface for supporting said article with said perforations exposed for impact;

a first retractable burst member and an opposed second retractable burst member arranged for movements toward and away from one another along a common axis passing through said first and second retractable burst members, said first and second retractable burst members each being arranged for applying a predetermined impact force on an end portion of said perforated lid;

a retractable separator member arranged in said frame for capturing said perforated lid and then separating said perforated lid from said main body portion at said perforations;

means for moving either of said first and second retractable burst members into engaging contact with a respective end portion of said perforated lid for forming at least partially burst first perforations nearest to said either of said first and second retractable burst members;

means for moving the other of said first and second retractable burst members into engaging contact with an opposing respective end portion on said perforated lid for forming at least partially burst, second perforations nearest said other of said first and second retractable burst members; and, means for moving said retractable separator member into a first position capturing said perforated lid and then to a second position separating said perforated lid from said main body portion of said article.

In another aspect of the invention, there is provided a method of opening a corrugated box having a perforated lid and a main body, said main body being separable from said perforated lid by perforations, said method comprising the steps of: a method of opening a corrugated box having a perforated lid and a main body, said main body being separable from said perforated lid by perforations, said method comprising the steps of:

providing the apparatus recited in claim 1;

positioning the box on said substantially flat, moveable surface so as to expose said perforations to an impact force;

moving said substantially flat, moveable surface having said box thereon into a first position between displaced said first and second retractable burst members;

moving said first retractable burst member into engaging contact with an end portion of said perforated lid thereby forming at least partially burst first perforations;

retracting said first retractable burst member from said perforated lid;

moving said second retractable burst member into engaging contact with an opposing end portion of said perforated lid thereby forming at least partially burst second perforations opposite said at least partially burst first perforations;

retracting said second retractable burst member from said perforated lid;

moving said retractable separator member into a first position capturing an end of said perforated lid; and, retracting said retractable separator to a second position thereby separating said perforated lid from said main body portion at said at least partially burst first and second perforations.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
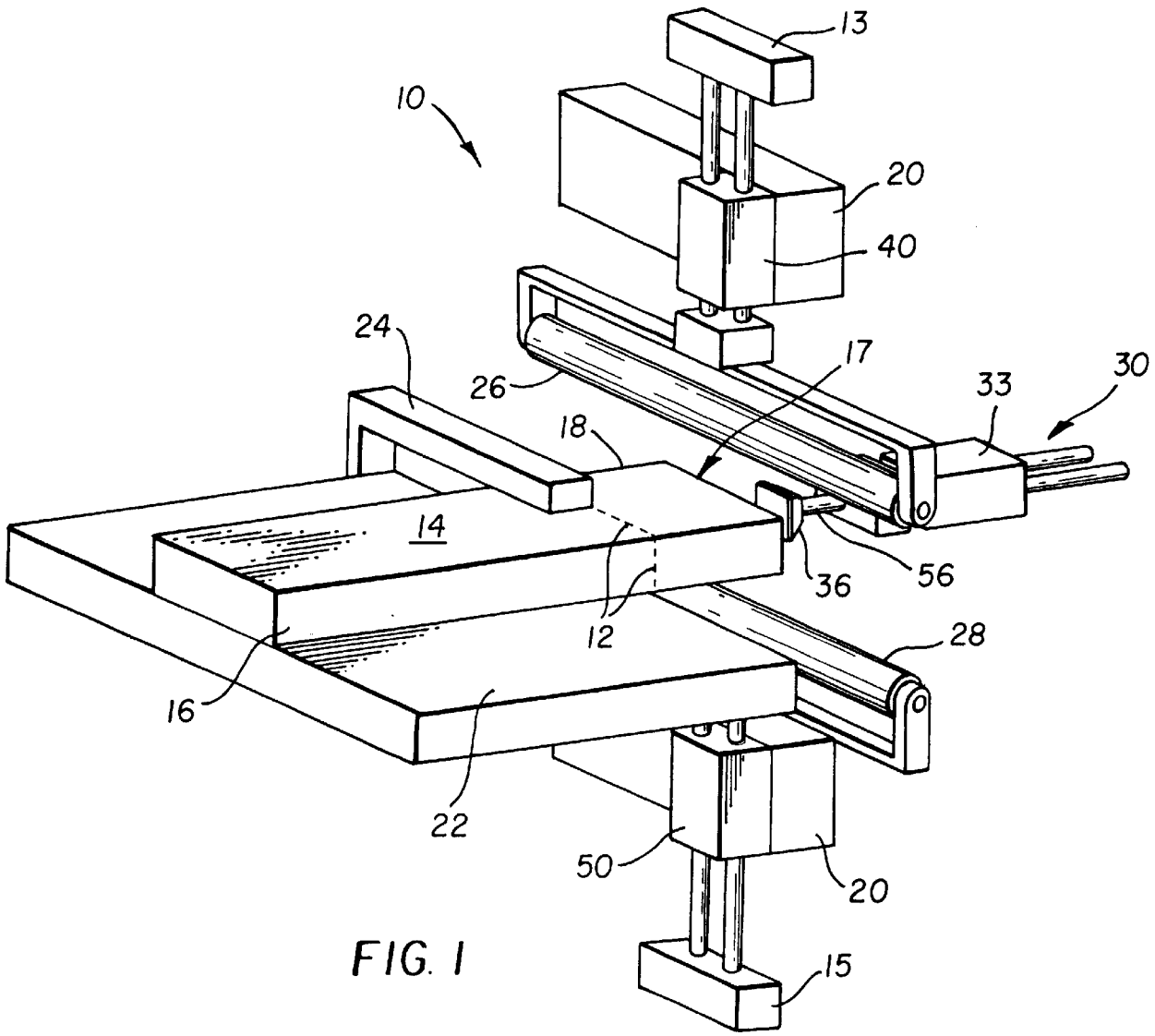
FIG. 1 is an isometric view of the apparatus of the invention.

Turning now to the drawings, and in particular to FIGS. 1–4, apparatus 10 for bursting perforations 12 on an article, such as a corrugated box 14 for storing X-ray sheet film, is illustrated. Generally, corrugated box 14 has a main body portion 16 and a perforated lid 18 separable from the main body portion 16 at perforations 12 along the periphery of the main body portion 16. Generally, apparatus 10 is used to separate or remove the perforated lid 18 from the main body portion 16. In an alternative embodiment, apparatus 10 is used to detect the separation of the perforated lid 18 from the main body portion 16. In yet another embodiment of the invention, apparatus 10 is used to replace the removed perforated lid 18 back onto a sleeve portion (not shown) of the main body portion 16 of the box to allow the perforated lid 18 to be easily removed by the end user.

Broadly defined apparatus 10 includes a frame 20 having a substantially flat, movable surface or platform 22 for supporting the box 14 with the perforations 12 exposed to receive an impact force. A clamp 24, or other similar means, is used to secure the box 14 to the substantially flat, moveable surface or platform 22 while the box 14 is experiencing an impact force.

Figure 2:
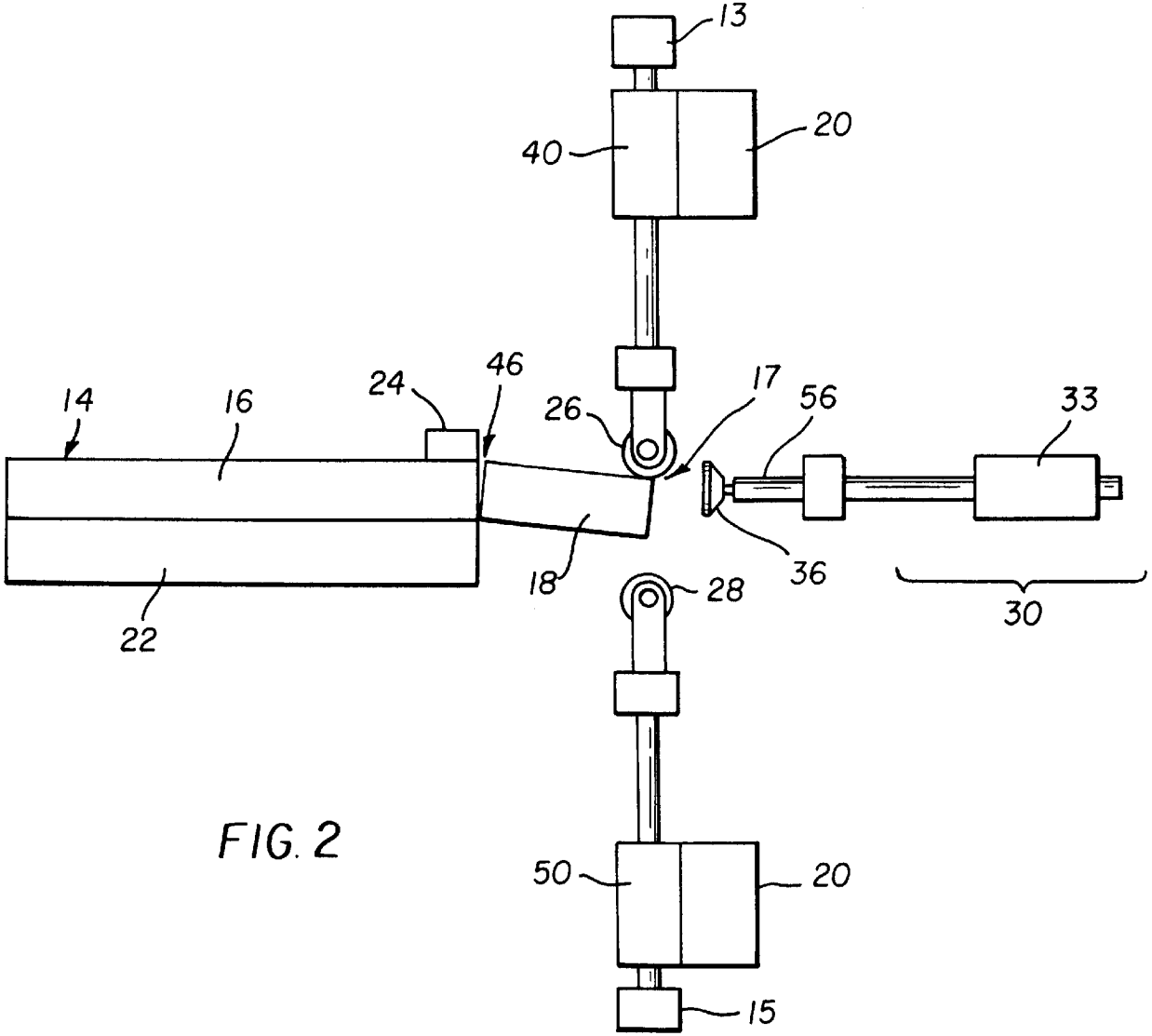
FIG. 2 is an elevated side view of the apparatus with a burst member engaging the perforated lid.
Figure 3:
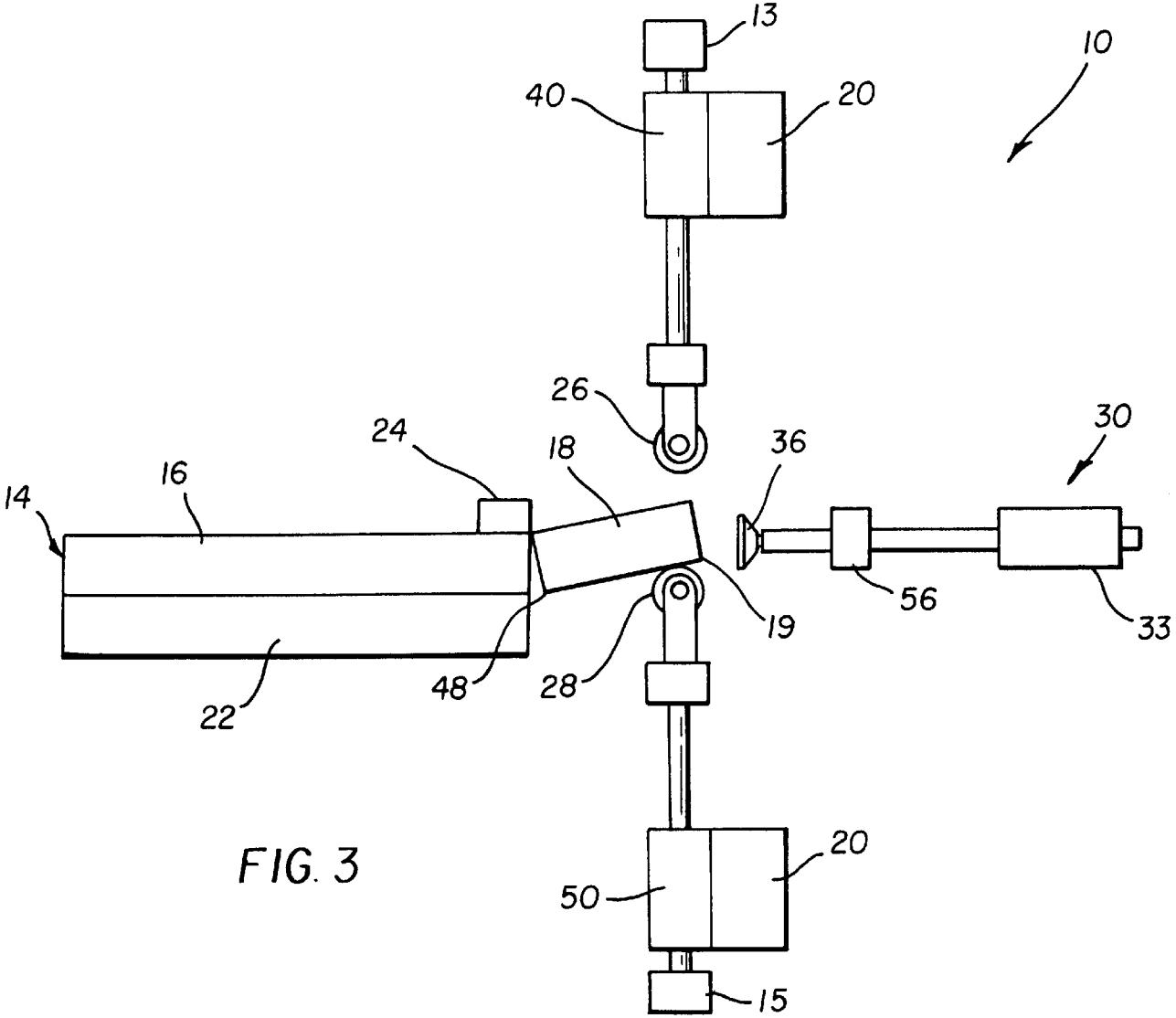
FIG. 3 is an elevated side view of the apparatus with another of the burst members engaging the perforated lid; and, FIG. 4 is a side view of showing the separator member engaging the perforated lid.
Figure 4:
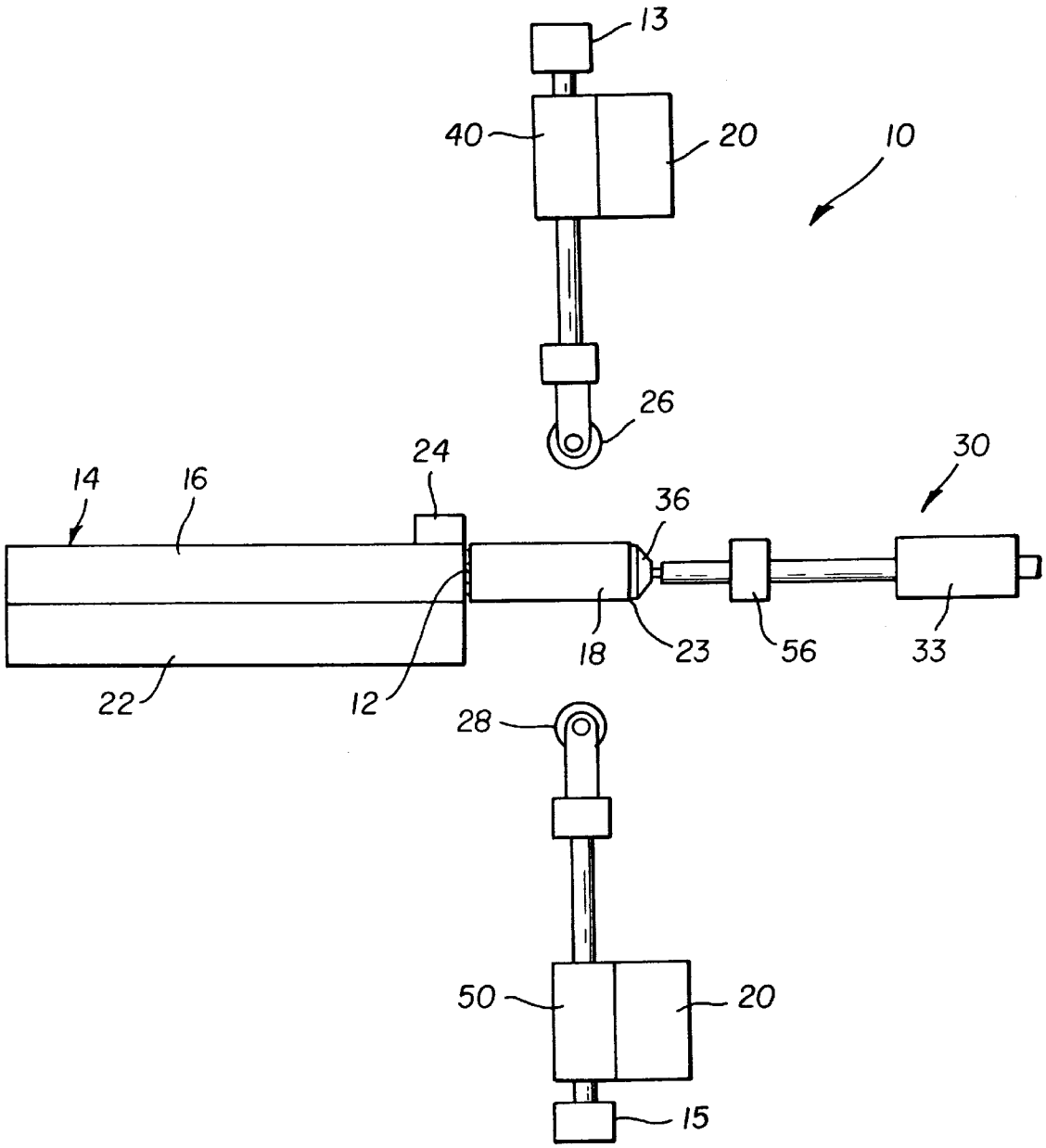
Figure 5:
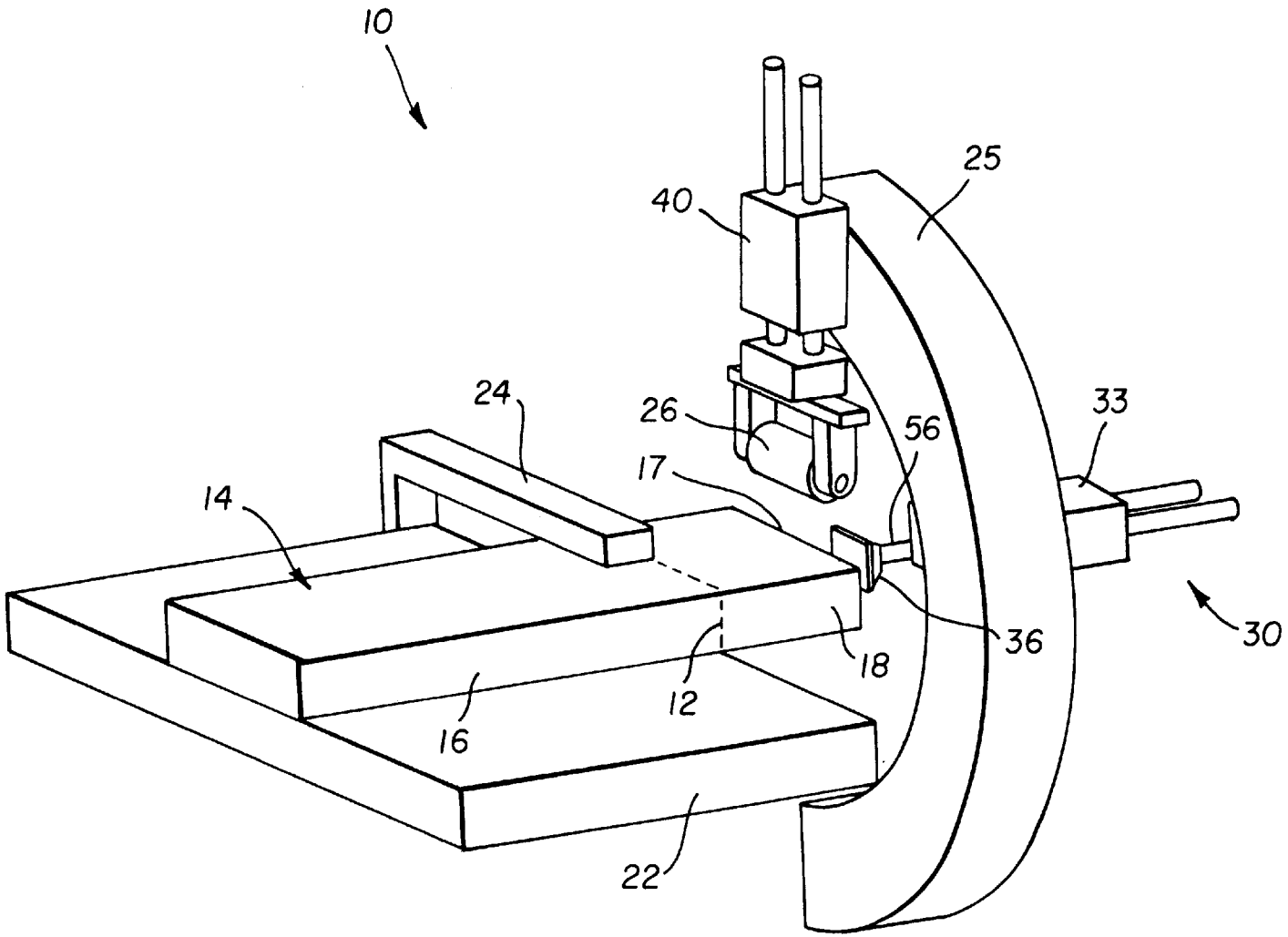
FIG. 5 is a side view of an alternative embodiment having a single, rotatable burst member for bursting perforations.

Referring to FIGS. 2 and 3, a first retractable burst member 26 and an opposed second retractable burst member or roller 28 are arranged on the frame 20 for vertical movements toward and away from one another along a common axis passing through the first and second burst members. In this configuration, first and second retractable burst members 26, 28 are each arranged on frame 20 for applying a predetermined impact force on an end portion 17 of the perforated lid 18.

Figure 6:
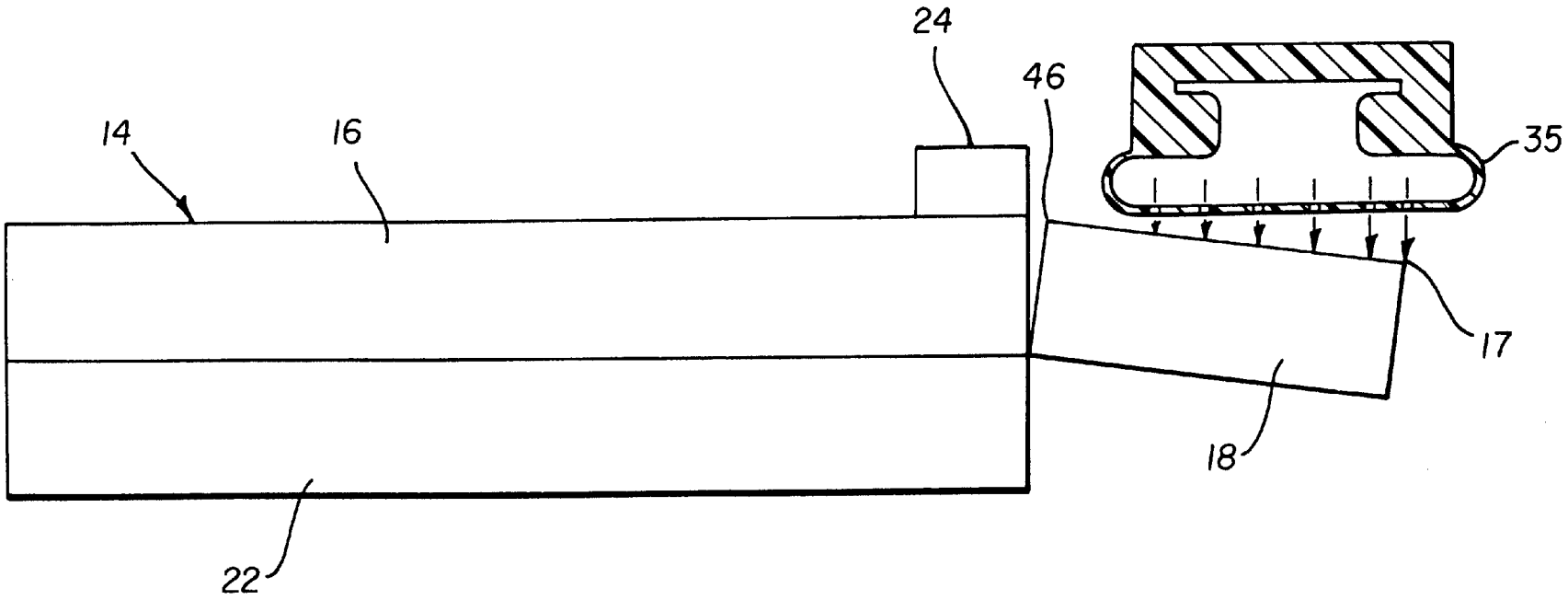
FIG. 6 is a partial side view of an alternative bursting member.

Alternatively, an air bladder 35 could be used to provide partially burst perforations, as shown in FIG. 6. Air impacts, shown by arrows in FIG. 6, would have the same effect as the first and second retractable burst members 26, 28. A stop member 13,15 may be used to stop the movement of either pneumatic cylinder 40, 50, respectively, after the respective burst members 26, 28 engage the perforated lid 18.

Referring again to FIG. 4, a retractable separator member 30 is arranged on the frame 20 for capturing the perforated lid 18 and then separating the perforated lid 18 from the main body portion 16 at the at least partially burst perforations 12. In the preferred embodiment, separator member 30 comprises a first pneumatic cylinder 33 operably connected to a vacuum suction cup 36. Vacuum suction cup 36 is also connected to a source of vacuum (not shown) for grasping an end portion 23 of the perforated lid 18.

In FIGS. 1–3, means, such as second and third pneumatic cylinders 40, 50, is operably connected to the first and second retractable burst members 26, 28, respectively. Second pneumatic cylinder 40 moves the first retractable burst member 26 into engaging contact with end portion 17 of the perforated lid 18. After burst member 26 applies a predetermined impact force on end portion 17, second pneumatic cylinder 40 then retracts first burst member 26 vertically away from the perforated lid 18. This impact force produces at least partially burst first perforations 46 on the article 14 near where the first retractable burst member 26 impacted the perforated lid 18. Similarly, third pneumatic cylinder 50 is adapted to move second retractable burst member 28 into engaging contact with a predetermined impact force with an end portion 19 of perforated lid 18 opposite the end portion 17. As a result of this force of impact, at least partially burst second perforations 48 are produced nearest the second retractable burst member 28.

Referring to FIGS. 1–6, a vacuum sensor 56 is used to sense when the perforated lid 18 is actually separated from the main body portion 16 by the retractable separator member 30. Vacuum sensor 56 is operably connected proximate to the vacuum suction cup 36.

In operations, an article, for instance a corrugated box 14 having a perforated lid 18, is transported to the apparatus 10 of the invention and positioned properly between the first retractable burst member 26, the second retractable burst member 28, and the retractable separator member 30. A box clamp 24 may be used to hold the box 14 securely against the substantially flat moveable surface or platform 22. As shown in FIG. 2, the first retractable burst member 26 is extended against an end portion 17 of the perorated lid 18, breaking the top portions of perforations 12 and approximately 60% of the side portions perforations 12 of the perforated lid 18, then retracted. As shown in FIG. 3, the second retractable burst member 28 is extended against an end portion 19 opposite end portion 17 of the perforated lid 18, breaking the bottom perforations and the remaining side perforations, then retracted. Next, the separator member 30 is extended against the perforated lid 18 and vacuum is applied to the vacuum suction cup 36. The separator member 30 is then retracted, breaking any residual fibers and separating the perforated lid 18 from the main body portion 16 of the box 14. Once the separator member 30 is detected, retracted and vacuum is detected via the vacuum sensor 56, separation of the perforated lid 18 from the main body portion 16 of box 14 has been achieved. If either vacuum sensor 56 or retraction sensor (not shown) for detecting retraction of the pneumatic cylinder 33 does not properly detect appropriate signals, the perforated lid 18 has not been separated and the process could be retried. However, once the perforated lid 18 is successfully separated, separator member 30 is extended, vacuum is turned off, the separator member 30 is retracted, and the perforated lid 18 is now in position to have a peel seal label (not shown) applied.

The invention has been described with reference to a preferred embodiment. However, it will be appreciated that variations and modifications can be effected by a person of ordinary skill in the art without departing from the scope of the invention.

PARTS LIST

10 box bursting apparatus
12 perforations
13 stop member
14 corrugated box (article)
15 stop member
16 main body portion of box 14
17 end portion of the perforated lid 18 of box 14
18 perforated lid of box 14
19 end portion of the perforated lid 18 of box 14
20 frame
22 substantially flat moveable surface (platform)
23 end portion of the perforated lid 18
24 clamp
25 rotary mechanism
26 first retractable burst member (roller)
28 second retractable burst member (roller)
30 retractable separator member
33 first pneumatic cylinder
35 air bladder
36 vacuum suction cup
40 second pneumatic cylinder
46 partially burst first perforations
48 partially burst second perforations
50 third pneumatic cylinder
56 vacuum sensor

What is claimed is:

1. Apparatus for bursting perforations on an article having a main body portion and a perforated lid, said perforated lid being separable from said main body portion at perforations along the periphery of said main body portion, said apparatus comprising:

a frame having a substantially flat, movable surface for supporting said article with said perforations exposed for impact;

a first retractable burst member and an opposed second retractable burst member arranged for movements toward and away from one another along a common axis passing through said first and second retractable burst members, said first and second retractable burst members each being arranged for applying a predetermined impact force on an end portion of said perforated lid;

a retractable separator member arranged in said frame for capturing said perforated lid and then separating said perforated lid from said main body portion at said perforations;

means for moving either of said first and second retractable burst members into engaging contact with a respective end portion of said perforated lid for forming at least partially burst first perforations nearest to said either of said first and second retractable burst members;

means for moving the other of said first and second retractable burst members into engaging contact with an opposing respective end portion on said perforated lid for forming at least partially burst, second perforations nearest said other of said first and second retractable burst members; and, means for moving said retractable separator member into a first position capturing said perforated lid and then to a second position separating said perforated lid from said main body portion of said article.

2. The apparatus recited in claim 1 further comprising a sensor means arranged proximate to said retractable separator member for detecting when said perforated lid is separated from said main body portion of said article, said retractable separator member being actuated by a first pneumatic cylinder.

3. The apparatus recited in claim 1 wherein said first retractable burst member comprises a first, generally cylindrical roller supported on a second pneumatic cylinder, and said second retractable burst member comprises a second, generally cylindrical roller supported on a third pneumatic cylinder.

4. The apparatus recited in claim 3 further comprising a first stop member structurally associated with said second pneumatic cylinder for limiting displacement of said second pneumatic cylinder; and a second stop member structurally associated with said third pneumatic cylinder for limiting displacement of said third pneumatic cylinder.

5. The apparatus recited in claim 1 wherein said retractable separator member comprises a vacuum suction cup operably connected to a source of vacuum.

6. The apparatus recited in claim 1 wherein a clamp member is provided on said frame for securing said article from movement on said substantially flat, moveable surface.

7. A method of opening a corrugated box having a perforated lid and a main body, said main body being separable from said perforated lid by perforations, said method comprising the steps of:

providing the apparatus recited in claim 1;

positioning said box on said substantially, flat moveable surface so as to expose said perforations to an impact force;

moving said substantially flat, moveable surface having said box thereon into a first position between displaced said first and second retractable burst members;

moving said first retractable burst member into engaging contact with an end portion of said perforated lid thereby forming at least partially burst first perforations;

retracting said first retractable burst member from said perforated lid;

moving said second retractable burst member into engaging contact with an opposing end portion of said perforated lid thereby forming at least partially burst second perforations opposite said at least partially burst first perforations;

retracting said second retractable burst member from said perforated lid;

moving said retractable separator member into a first position capturing an end of said perforated lid; and, retracting said retractable separator to a second position thereby separating said perforated lid from said main body portion at said at least partially burst first and second perforations.

8. The method recited in claim 7 wherein the steps of moving said first and second retractable burst members into engaging contact includes the step of applying a predetermined impact force on said respective end portions of said perforated lid.

* * * * *